US008735811B2

(12) United States Patent
Makarov

(10) Patent No.: US 8,735,811 B2
(45) **Date of Patent: *May 27, 2014**

(54) MULTI-CHANNEL DETECTION

(75) Inventor: Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/345,329

(22) Filed: Jan. 6, 2012

(65) Prior Publication Data

US 2012/0104245 A1 May 3, 2012

Related U.S. Application Data

(63) Continuation of application No. 12/444,838, filed as application No. PCT/EP2007/008985 on Oct. 17, 2007, now Pat. No. 8,093,554.

(30) Foreign Application Priority Data

Oct. 20, 2006 (GB) ..... 0620963.9

(51) Int. Cl.
*H01J 49/40* (2006.01)

(52) U.S. Cl.
CPC ..... *H01J 49/406* (2013.01); *H01J 49/408* (2013.01)
USPC ..... 250/287; 250/281; 250/282

(58) Field of Classification Search
USPC ..... 250/281, 282, 287
See application file for complete search history.

(56) References Cited

U.S. PATENT DOCUMENTS

| | | | | |
|---|---|---|---|---|
| 3,510,647 | A * | 5/1970 | Wood | 250/281 |
| 6,674,068 | B1 * | 1/2004 | Kammei | 250/287 |
| 6,933,497 | B2 | 8/2005 | Vestal | |
| 7,312,441 | B2 | 12/2007 | Land et al. | |
| 7,326,925 | B2 * | 2/2008 | Verentchikov et al. | 250/287 |
| 8,093,554 | B2 * | 1/2012 | Makarov | 250/287 |
| 2006/0214100 | A1 | 9/2006 | Verentchikov et al. | |
| 2007/0194223 | A1 | 8/2007 | Sato et al. | |

FOREIGN PATENT DOCUMENTS

| | | | |
|---|---|---|---|
| DE | 10296885 | T5 | 8/2004 |
| GB | 2 339 958 | A | 2/2000 |
| WO | 02097856 | A2 | 12/2002 |
| WO | 2005114702 | A1 | 12/2005 |
| WO | WO 2005/124821 | A2 | 12/2005 |

* cited by examiner

*Primary Examiner* — Jack Berman
(74) *Attorney, Agent, or Firm* — Charles B. Katz

(57) ABSTRACT

A mass spectrometer and method of mass spectrometry wherein charged particles in a beam undergo multiple changes of direction. A detection arrangement detects a first portion of the charged particle beam, and provides a first output based upon the intensity of the detected first portion of the charged particle beam. The detection arrangement detects a second portion of the charged particle beam that has traveled a greater path length through the mass spectrometer than the first portion of the charged particle beam, and provides a second output based upon the detected second portion of the charged particle beam. A controller adjusts the parameters of the charged particle beam and/or the detection arrangement, based upon the first output of the detection arrangement, so as to adjust the second output of the detection arrangement.

25 Claims, 3 Drawing Sheets

MULTI-CHANNEL DETECTION

CROSS-REFERENCE TO RELATED APPLICATIONS

The present application is a continuation under 35 U.S.C. §120 and claims the priority benefit of co-pending U.S. patent application Ser. No. 12/444,838, filed Apr. 8, 2009, which is the United States National Stage Application, under 35 U.S.C. 371, of International Application PCT/EP2007/008985 having an international filing date of Oct. 17, 2007. The disclosures of each of the foregoing applications are incorporated herein by reference.

TECHNICAL FIELD

This invention relates to detection of charged particles in an instrument having a flight path with multiple reflections.

BACKGROUND TO THE INVENTION

In time-of-flight (TOF) mass spectrometers, charged particles are accelerated along a flight path by the application of an electric potential and mass-to-charge ratios (m/z) are determined by measuring time of flight over a predetermined distance using a detection arrangement. When choosing a detector arrangement, considerations may include: the response time of the detector; the detector dynamic range; the smallest detectable signal (detection limit); the ability to detect multiple charged particles arriving at the detector at the same time; and the time resolution of the detector, which is its ability to differentiate between particles arriving at the detector at different times.

The time taken by a charged particle to reach a given point or plane depends on its initial kinetic energy, its m/z ratio and the length of the flight path. Orthogonal TOF mass spectrometers typically have a relatively short flight path. Therefore, particles of different m/z ratio will not have a significant difference in their time of flights, and so these mass spectrometers are limited in their mass resolution even for well-defined ion beams and with fast acquisition systems. A useful high dynamic range is achieved in these TOF spectrometers by the summation of a great many spectra, each spectrum typically containing tens to hundreds detected ions. In addition, detectors with several anodes could be employed, each anode having an individual output.

The length of the flight path may be increased without significantly increasing the size of the instrument by causing the charged particle beam to be reflected multiple times thus folding ion trajectories within a limited volume. This is achieved by using multiple electrostatic ion mirrors, or multiple electrostatic sectors, or any combination of the above. In many cases, multiple mirrors or sectors could be replaced by an integrated construction extended along a direction substantially orthogonal to the direction of time-of-flight separation. The extent to which this increase in the length of flight path is desirable depends on the capabilities of the detection arrangement.

All these systems are characterised by a multitude of segments, each segment having a region of ion acceleration, (i.e. reflection or deflection region) followed by a region where such acceleration is relatively small (i.e. substantially field-free region). Here and below, all such systems will be referred as multi-reflection TOF.

From an ion optical point of view multi-reflection TOFs are a sub-class of a more general class of electrostatic traps, and could be subdivided into "open type" and "closed type" multi-reflection TOFs. "Open type" relates to systems where ion trajectories can not be confined within the trap for an indefinite time but only for a limited number of reflections. Typically the ion path is not reflected onto itself. Such systems do not suffer from limitations of mass range typical for "closed-type" electrostatic traps where ions are forced to follow substantially the same path and therefore different regions of m/z range increasingly overlap.

The main advantage of multi-reflection TOF mass spectrometers is the increase of the length of the flight path and thereby of the time-of-flight. Hence the difference in time of flight between particles of different m/z ratios (i.e. TOF dispersion) is increased, thus improving the mass resolution. At the same time, as the time of flight is increased, the repetition rate is reduced. The reduced repetition rate reduces the number of spectra that can be summed and therefore limits the dynamic range the spectrometer can achieve, in a given time period.

The duty cycle of analysis is also reduced but it could be restored by using ion storage devices for accumulating ions between injections into TOF. However, use of ion storage devices to preserve duty cycle increases the number of ions in each mass peak thus increasing the range of intensities in a single shot beyond capabilities of known detectors.

Hence, existing TOF instruments are unable to provide high mass resolution together with high dynamic range. They are therefore unable to differentiate between one type of particle, with a first m/z ratio, in high abundance in a charged particle beam, and a second type of particle, with an m/z ratio close to the first m/z ratio, but in low abundance in the beam.

SUMMARY OF THE INVENTION

Against this background, the present invention provides, in a first aspect, a mass spectrometer, comprising: an electrode arrangement for causing the charged particles in the beam to undergo multiple changes of direction; and a detection arrangement, arranged to detect a first portion of the charged particle beam at a first detection time, and to provide a first output based upon the intensity of the detected first portion of the charged particle beam, the detection arrangement further arranged to detect a second portion of the charged particle beam at a second detection time, and to provide a second output based upon the detected second portion of the charged particle beam.

The first output comprises information about the intensity of the detected first portion of the charged particle beam. The first output may thereby be arranged to provide a signal that varies in dependence on the intensity of the detected first portion of the charged particle beam. Advantageously, the first output is additionally based upon the time of flight of the detected first portion of the charged particle beam. Preferably, the detection arrangement is arranged to detect the first portion of the charged particle beam at a temporal focusing location. This is typically accompanied by improved performance. The detection arrangement may alternatively or additionally be arranged to detect the second portion of the charged particle beam at a temporal focusing location.

The mass spectrometer further comprises a controller, arranged to adjust the parameters of the charged particle beam and/or the detection arrangement, based upon the first output of the detection arrangement, so as to adjust the second output of the detection arrangement. The controller may thereby use the information about the intensity of the detected first portion of the charged particle beam from the first output.

This advantageously provides a multi-reflection device, having a lengthened flight path, where the first output of the detection arrangement may be used to adjust the second output from the detection arrangement. This configuration may allow optimisation within the linear range of a detector, protection of detectors from saturation or from noise (caused, for example, by scattered ions), improvements in throughput, improvement in the mass resolution of intense ion beams and an increase in dynamic range. Advantageously, the controller may adjust the second output of the detection arrangement to be within a desired range. The desired range for the second output may be accordingly set to achieve each of these improvements. These multi-reflection devices may include multi-sector instruments.

Preferably, the electrode arrangement is arranged to cause the charged particles in the beam to undergo multiple changes of direction of at least 45 degrees. Optionally, the electrode arrangement is arranged to cause the charged particles in the beam to undergo multiple reflections.

Preferably, the electrode arrangement defines a flight path for the charged particle beam and the detection arrangement is located substantially towards the end of that flight path, for example along the last 50% of the flight path, or more preferably along the last 20%, 10% or 5% of the flight path. By arranging the detectors further towards the end of the flight path, the ions within each pulse have separated in time according to their mass to charge ratio nearly to the maximum amount, providing maximum mass resolution.

In the preferred embodiment, the electrode arrangement causes the charged particles in the beam to undergo at least 3 reflections. Optionally, at least 5, 10, 20, 100 or 200 reflections may be used. With appropriately designed ion mirrors (e.g. with $3^{rd}$ or higher order TOF focusing on energy and $1^{st}$ or $2^{nd}$ order focusing on other initial parameters), the longer the flight path, the better is the mass resolution.

In certain embodiments, the second output of the detection arrangement may be based upon the time-of-flight of the detected second portion of the charged particle beam. The second output may alternatively or additionally be based upon the intensity of the detected second portion of the charged particle beam. This is particularly applicable to time-of-flight mass spectrometers, where each output of the detection arrangement is recorded as an intensity of signal from a detector received at a given time. In this way, the output comprises information about both the intensity and the time-of-flight of the detected portion of the charged particle beam.

When the second output is based upon the time-of-flight of the detected second portion of the charged particle beam, the controller may be configured to adjust the second output, that is based upon the time-of-flight, on the basis of the first output. The second output can therefore be adjusted. In this way, the measured time-of-flight of a peak from the second output may be shifted on the basis of intensity of that peak in the first output, such that time-of-flight corrections in the vicinity of intense peaks may be different from corrections of time-of-flight for other mass peaks.

Where the second output is based upon the intensity of the detected second portion of the charged particle beam, the second output, that comprises intensity information, may be adjusted using the first output, that also comprises intensity information. In such embodiments, saturation of the detection arrangement when detecting the second portion of the ion beam may be avoided by controlling the detection arrangement on the basis of the first output.

The detection arrangement may comprise a single detector located at a temporal focusing region, to provide a first output for a first portion of the charged particle beam and subsequently a second output for a second portion of the charged particle beam. Alternatively, the detection arrangement may comprise a first detector located at a first temporal focusing region, to provide a first output for a first portion of the charged particle beam and a second detector, located at a second temporal focusing region, to provide a second output for a second portion of the charged particle beam. In this case, the first portion of the ion beam may optionally be smaller than the second portion of the ion beam. The second portion of the ion beam may be at least 3 times the size of the first portion. Alternatively, the second portion may be 5, 10, 20, 50 or 100 times bigger than the first portion. Optionally, the second portion of the beam comprises all remaining ions not detected in the first portion of the beam.

If the detection arrangement comprises multiple detectors, the first detector and second detector may optionally comprise at least one common amplification stage. Advantageously, the detectors may be integrated in the same constructions. Preferably, the detectors may share a common microchannel plate or microchannel plates, as these may be expensive.

The controller may be arranged to control the sensitivity of the second detector based upon the first output of the first detector, so as to adjust the second output. Additionally or alternatively, however, the detection arrangement of the preferred embodiment may further comprise a first modulator, located between the first detector and the second detector. The first modulator may prevent a proportion of the charged particle beam from onward transmission towards the second detector, the proportion being determined based upon the first output of the said first detector. Thus the controller is able to control the second input by preventing a proportion of the beam from reaching the second detector, thus bringing the second output of the said second detector within a desired range. The benefit of this is that the output of the second detector can be controlled rapidly without adjustment to the sensitivity of the second detector, i.e. without any adjustment of corresponding electronics. Also, saturation of the second detector and its accompanying adverse effects (such as reduction of life-time of the second detector, peak tailing and ringing) are avoided. Nevertheless, it is of course possible to control both the number of ions in the beam that reach the second detector, by way of the modulator, and also (simultaneously) to control/adjust the sensitivity of that second detector.

The modulator is optionally configured to deflect at least a portion of the charged particle beam, preferably towards a baffle or away from ion optical elements. The modulator may optionally reduce the quantity of ions detected as part of the second portion of the charged particle beam on the basis of the first output of the detection arrangement being greater than a predetermined threshold. This may be used to stop intense parts of the ion beam from reaching the second detector. The modulator is advantageously located at a temporal focusing region. The detection arrangement may comprise a second output part, which provides the second output. The modulator may then be preferably located at the temporal focusing region immediately upstream from said second output part.

This approach offers an advantage when compared with alternatives that are simpler in construction, for example, using a single detector first at a low gain and then at a higher gain. In embodiments using multiple detectors, fast variations or irreproducibility in the incoming ion packets do not affect the relationship between the respective mass peak intensities of the first and second outputs. Therefore, peaks in both outputs could be continuously used for recovering the true intensity of the original ion packet, thus providing better linearity of response. Additionally, a two-fold factor reduction in duty cycle is also beneficial for instrument performance.

Optionally, the detection arrangement may comprise a third detector and second modulator. The controller may then be further adapted to adjust the parameters of the detection arrangement (e.g. a third input ion beam) based upon the output of the first detector, and alternatively or additionally based upon the output of the second detector. The third detector may detect a bigger portion of the beam than the second detector. Optionally, the third detector may detect 3, 5, 10, 20, 50, or 100 times the size of the beam of the second detector. Optionally, the third detector detects the complete portion of the charged particle beam not detected by either the first detector or second detector.

In the preferred embodiment, the spectrometer further comprises an ion source, arranged to generate charged particles; and an acceleration electrode arrangement, arranged to accelerate the charged particles so as to form the beam. The mass spectrometer may further comprise a pulsed ion storage. This may be axial or orthogonal extraction ion storage.

In a second aspect, the present invention provides a method of mass spectrometry comprising the steps of: causing a charged particle beam to undergo multiple reflections using an electrode arrangement; detecting a first portion of the charged particle beam at a temporal focusing region using a detection arrangement, the detection arrangement having a first output based upon the detected first portion of the charged particle beam; detecting a second portion of the charged particle beam at a temporal focusing region using the detection arrangement, the detection arrangement having a second output based upon the detected second portion of the charged particle beam; and adjusting the parameters of the charged particle beam and/or the detection arrangement, based upon the first output of the detection arrangement, so as to adjust the second output of the detection arrangement.

BRIEF DESCRIPTION OF THE DRAWINGS

The invention may be put into practice in various ways, one of which will now be described by way of example only and with reference to the accompanying drawings in which.

SPECIFIC DESCRIPTION OF A PREFERRED EMBODIMENT

Figure 1:
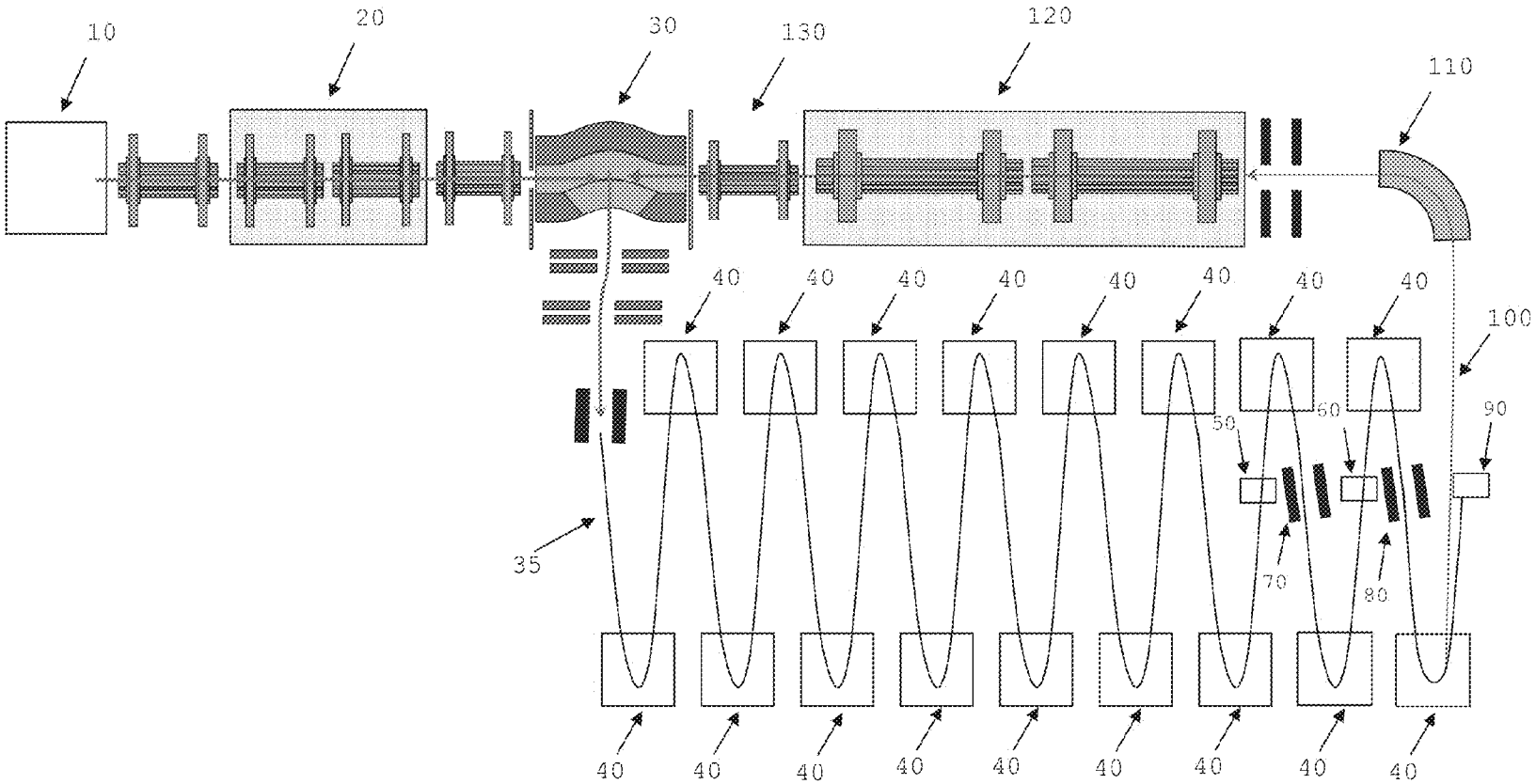
FIG. 1 shows a mass spectrometer according to the present invention.

Referring first to FIG. 1, a mass spectrometer according to the present invention is shown.

The mass spectrometer comprises: an ion source 10; a plurality of ion mirrors 40, which deflect a charged particle beam 35; and detection arrangement including a first charged particle detector 50; and a second charged particle detector 60. Charged particles are generated by the ion source, formed into charged particle beam 35, and reflected multiple times by the ion mirrors 40. The large number of ion mirrors 40 allow the ion beam to travel a long flight path within an instrument of reasonable size.

The mass spectrometer of FIG. 1 also includes: a pre-trap 20; ion storage 30; an optional transport electric sector (or equivalent transporting ion optics) 110; a fragmentation cell 120; and a transport multipole lens 130. The detection arrangement of the mass spectrometer further includes: a first modulator 70; a second modulator 80; a third detector 90.

This arrangement, and in particular the large number of ion mirrors (which may cause hundreds of reflections), means that charged particles are held within the multi-reflection spectrometer for relatively long durations, so that they travel a long distance within the instrument. This distance can be from a few meters for portable instruments to several kilometers for large laboratory instruments, but always significantly larger than the physical length of the corresponding vacuum chamber. In comparison, conventional orthogonal time-of-flight spectrometers allow a flight path which is typically not more than 2 to 4 times longer than the length of their vacuum chamber. The increased time that the particles travel in the spectrometer translates into an increased temporal separation of particles having different mass-to-charge ratios, and therefore increased mass-to-charge resolution with appropriately designed mirrors.

Particles of the same m/z ratio may have different initial kinetic energies. The spectrometer is preferably designed so that between mirrors, there is at least one temporal focusing point or plane. These are locations along the flight path at which charged particles of a given m/z ratio arrive at the same time, irrespective of their initial energy, co-ordinates or angles up to $1^{st}$, $2^{nd}$, $3^{rd}$ or higher order of approximation.

The charged particle beam then passes through the detection arrangement, located towards the end of the flight path, starting with first detector 50. First detector 50 is located at a temporal focusing point or plane. A second detector 60 is located at a second temporal focusing point or plane. By locating these detectors at temporal focusing points, the spread in time-of-flight of particles having the same m/z ratio is minimised. This is important so that ions of slightly different m/z can be separated in time when they reach the detectors and can therefore be resolved.

The distance along the charged particle flight path between the first and second detector is such that information gained from the first detector can be used in real-time before the corresponding charged particles arrive at the second detector, for instance some several tens of microseconds later.

This allows sufficient time for adjusting the parameters of the detection arrangement, specifically to improve the performance of subsequent detectors, such that their output is within an acceptable range. This is performed in a number of ways.

The instrumental parameters of a subsequent detector could be adjusted, for example to improve the detection performance of the subsequent detector by adjusting the electrical potentials controlling it. For example, this can be used to alter the gain or sensitivity of a second detector comprising an electron multiplier. This may be used to avoid the output of the second detector from saturating or from the output signal going below the noise floor of the device and may be used to normalise the output of the second detector such that both small and large signals from the detected charged particles can be measured accurately.

Some or all of the corresponding ions can be deflected away from the second subsequent detectors, for example to protect those subsequent detectors from overload. A first modulator 70 is provided to control the ion beam in response to the output of the first detector 50. For instance, if the first detector detects a high abundance at a certain arrival time, corresponding to a given m/z ratio, the modulator may in response deflect the portion of the beam having that m/z ratio away from the second detector 60 to avoid saturation of the second detector 60. The use of a modulator, together with the long flight path and a sufficient distance between first and second detectors, allows adequate time for this modulation to be controlled such that only the portion of the beam that is likely to cause saturation of the second detector 70 is deflected.

The modulator is positioned preferably in a temporal focus between detectors, being activated to deflect the packet of charged particles a certain time after the detection of a portion of the beam at the first detector surface. This time delay corresponds to the time taken for the charged particles to travel from the first detector surface to the beam modulator, and which might be a few to several tens of microseconds. If, on the other hand, the signal detected on the first detector is below a threshold, charged particles in the corresponding beam packet are not deflected but are allowed to travel to the second detector surface.

The detection of a packet of charged particles at a first detector is also used to indicate if an insufficient number or too many charged particles had been sampled and introduced into the trap or spectrometer, in which case a decision based upon that data could be made to abort the analysis of those charged particles and re-sample a smaller or larger proportion of sample charged particles, improving the throughput of the instrument.

In the embodiment shown, a third detector 90 is provided. The third detector has a different detection efficiency than the first and second detectors. Generally, each detection surface is provided with a differing (normally, ascending) detection efficiencies. In other words, each detector intercepts a different proportion of the charged particle beam. Then, by use of the first and second detectors, all three detectors can be controlled to function within their linear dynamic range.

A second modulator 80 is provided at a TOF focus between second and third detectors to deflect the beam based on the output of the first and second detectors. Some of the beam may be deflected towards third detector 90.

A portion of the charged particle beam 100 may be deflected towards an optional electric sector 110. This deflects the beam towards fragmentation cell 120 (which also could be used for ion storage), transport multipole lens 130 and to ion storage 30, from where the beam may then again be directed back onto path 35 towards ion mirrors 40. This cycle of selection, (optional) fragmentation/reaction in the cell 120 and injection into mass analyser could be repeated multiple times.

Deflection towards electric sector 110 and cell 120 could be performed by any of modulators. This arrangement could serve several purposes, for instance enrichment of small components and selection of intense peaks only (e.g. for MS/MS experiments). Selected intense peaks preferably by-pass detectors or modulators downstream.

Using this arrangement, the repetition rate must be much reduced with respect to orthogonal time-of-flight mass spectrometers. Orthogonal time-of-flight mass spectrometers might have a repetition rate of many thousands of times per second, and a mass-to-charge spectrum is built up by summation of many spectra over some seconds. Multi-reflection, oscillatory or orbital traps or spectrometers on the other hand, including the embodiment shown in FIG. 1, might take a few milliseconds to several hundreds of milliseconds to record a single high-resolution spectrum.

It is highly desirable to send a great many charged particles on their journey at one time, so that the signal recorded contains as many ions as possible. Highly specialised ion injection devices have been developed to controllably inject up to hundreds of thousands of ions into such traps or spectrometers for this purpose.

Figure 2A:
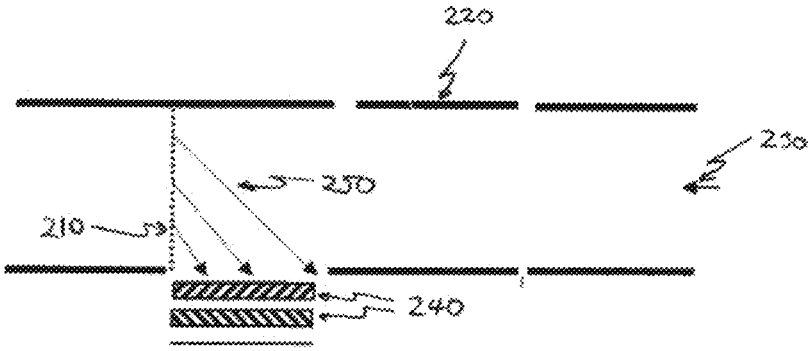
FIG. 2*a* shows a side view of a detector for use in the mass spectrometer of FIG. 1.

Referring now to FIG. 2*a*, a side view of an electron multiplier detector for use in such mass spectrometer of FIG. 1 is shown. The detector comprises a conversion grid 210; a compensating electrode 220; and microchannel plates 240. Charged particles 230 are directed towards conversion grid 210. Some of the charged particles are intercepted by conversion grid 210, generating electrons 250, which are then detected by microchannel plates 240.

Figure 2B:
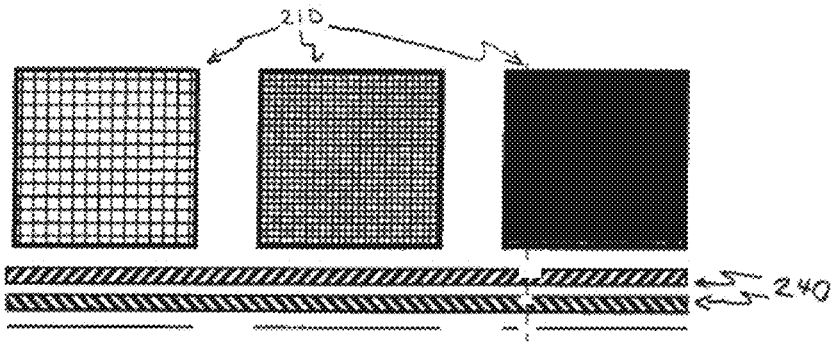
FIG. 2*b* shows a front view of the detector of FIG. 2*a*.

FIG. 2*b* shows a front view of a detector according to FIG. 2*a*. Three conversion grids 210 and microchannel plates 240 are shown. In the present embodiment each of the three detectors has a different detection efficiency. The first detector is formed using a 99% transmission conductive grid, the second formed using a 90% transmission conductive grid and the third using a solid conductive detector surface.

Then, if the first detector surface that intercepts 1% of the charged particles produces a signal that is above a set threshold, detection using the second detector, or third detector, may be avoided by deflecting the corresponding portion of the mass range in the charged particle beam before it reaches the second detector surface, by the use of beam modulator 70 or beam modulator 80.

The dynamic range of electron multiplier detectors remains substantially linear for charged particle arrival rates of up ~$10^6$ particles per second for continuous beams, and up to $10^8$-$10^9$ for pulsed beams. At arrival rates above this, the output from the multiplier becomes non-linear and also has a response that extends over a disproportionately long time period (known as peak tailing). This non-linearity and peak tailing period cause the detector to be unable to accurately record a smaller signal arriving shortly after the first. Also, mass resolution and mass accuracy suffer for the more intense ion signals as more charge is emitted by the detector.

In multiple-reflection time-of-flight mass spectrometers, the long flight time leads to a high resolution. Then, the temporally focused ions of one mass-to-charge ratio might all arrive at a temporal focal point within ~5 to 20 nanoseconds. Consequently the linear dynamic range in such a case is only some 10 to 50 ions per peak, corresponding to a peak ion arrival rate of ~$2\times10^9$ ions per second. The use of three detection surfaces in the embodiment described means that the 10 to 50 ions able to be detected by the first detector corresponds to 1000 to 5000 ions in a mass peak. The 10 to 50 ions able to be detected by the second detector corresponds to ~100 to 500 ions in the original mass peak. The final detector records ions over the range from single ions to 50 ions. The use of the three detectors in this example thereby increases the useful dynamic range of the detector by 2 orders of magnitude.

Figure 3:
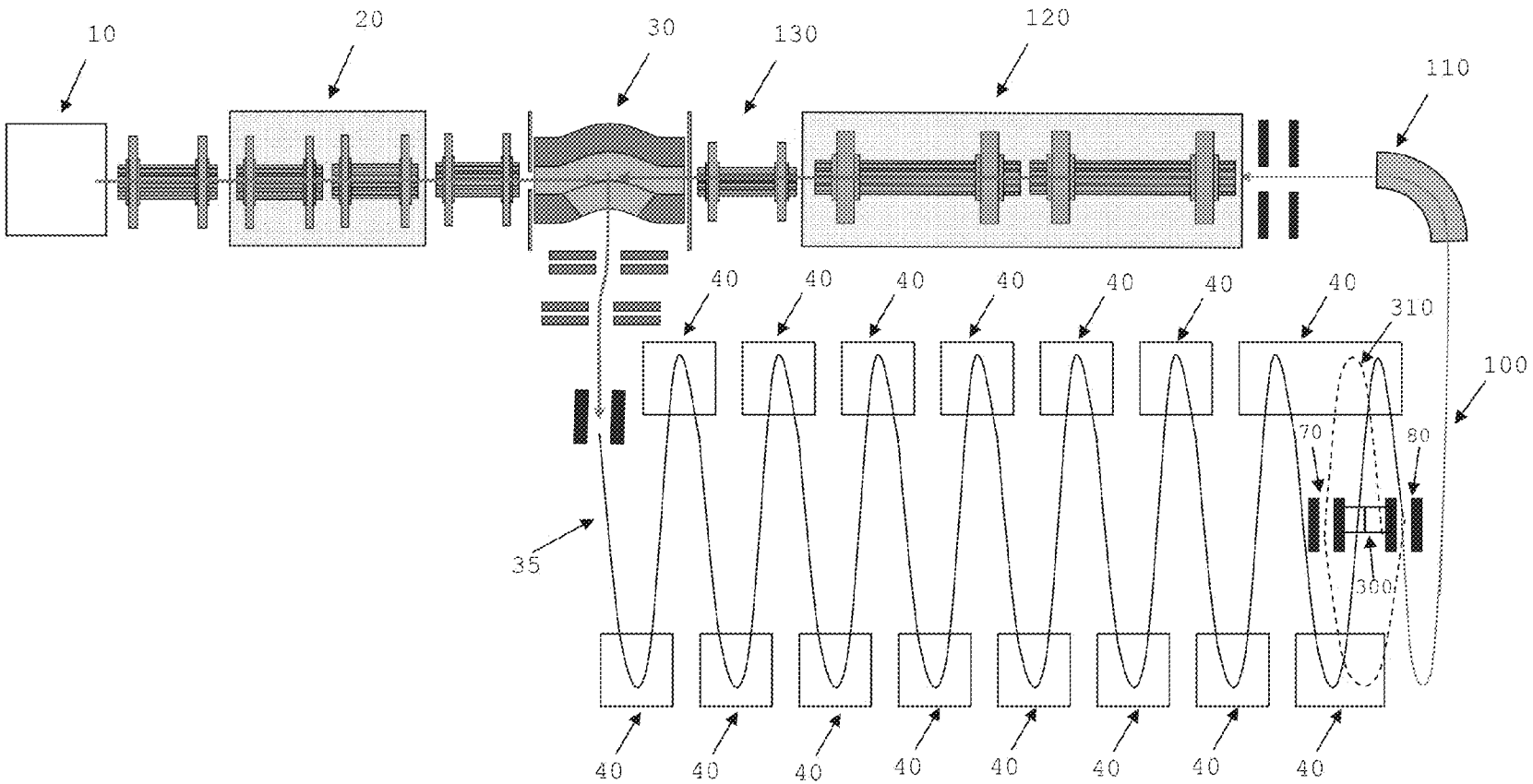
FIG. 3 shows the mass spectrometer of FIG. 1, with a compact two-stage detector.

The distance between detectors is defined by the period of ion mirrors 40. This period normally significantly exceeds the typical size of microchannel plates used in FIG. 2. FIG. 3 shows the mass spectrometer of FIG. 1, using a compact two-stage detector. To provide a more compact and cheaper detector without the reduction of the spatial period of mirrors 40, first deflector 80 and then deflector 70 are used to direct ions onto a loop trajectory 310 so that ions are then detected by detector 300. This embodiment allows the detector arrangement to be implemented using a compact integrated detector with small microchannel plates.

Whilst a specific embodiment has been described herein, the skilled person may contemplate various modifications and substitutions. For instance, although the embodiment described above comprises three detectors, the skilled person will appreciate that many more detectors may be used. Equivalently, the number of modulators may be varied.

Although the long path lengths of the preferred embodiment are desirable at the present time because of current detector and electronic limitations, it should not be taken to limit the invention.

Although the present invention may be used to adjust the detected intensity of the second portion of the ion beam, it may also be used to adjust other measured characteristics of the second portion of the ion beam. For example, the detected m/z ratio of the second portion of the ion beam may be adjusted as follows.

The position of a peak in the second output may be adjusted as a function of total ion charge injected. The magnitude of adjustment is deduced from calibration experiments. However, time-of-flight shifts in the vicinity of intense peaks in the second portion of the ion beam may be different from time-of-flight shifts to ions having times-of-flight that are not in the vicinity of an intense peak. Such an effect may be caused by space-charge effects during multiple reflections but also by the physical limitations of the detector itself (e.g. delayed recovery of voltage distribution on the voltage divider after an intense pulse of current). Hence, when the first detector detects an intense peak, the output of the second detector is adjusted to compensate for the different time-of-flight error, compared with other ions.

Alternatively, the present invention may be embodied using a single detector. In a first iteration, the detector detects a first portion of the charged particle beam and produces a first output. Then, based on the first output of the detector, the charged particle beam is modulated, or the detector parameters are adjusted, before or whilst the charged particle beam is accelerated around the mass spectrometer for a second iteration. During the subsequent iterations, the detector then detects a second portion of the charged particle beam.

When the present invention is embodied using a single detector and the charged particle beam is modulated, the modulator is preferably located in one of time-of-flight focusing regions preceding the detector. In the preferred embodiment, the modulator is preferably positioned in the time-of-flight focusing region located immediately upstream of the detector, since the time-of-flight dispersion is maximum at that point.

In this context, modulation relates to removal of exceedingly intense peaks and allowing low-intensity peaks to pass through. A threshold may be used on the first output, such that if the intensity of a peak detected in the first portion of the charged particle beam passes the threshold, the second portion of the ion beam is modulated to reduce the intense peak and thereby increase the detection sensitivity to other adjacent peaks. Unlike some existing systems, modulation in this context does not refer to attenuation of the entire beam.

The invention may be embodied in a variety of instruments including multi-reflection, oscillatory or orbital traps or spectrometers.

The present invention may also be applied to so-called "closed-type" traps.

The detection arrangement may comprise a conversion dynode and electron multiplier, using fast HV-switching technology. This detection arrangement may be located such that during the multiple reflections, the ion beam passes between the dynode and electron multiplier, such that ion packets may be sampled with high temporal resolution.

A further embodiment of the present invention comprises a mass spectrometer wherein the flight path is divided into a plurality of spatially separated legs, wherein at least the first leg comprises an electrode arrangement to cause the charged particles in the beam to undergo multiple reflections. The beam may be directed through the first leg, or a first number of legs for a pre-determined number of oscillations. The charged particle beam is then directed into the final leg or legs for a final number of iterations.

The detection arrangement is located in the final leg or legs. The detection arrangement may comprise a first detector and a second detector, or only a single detector, as described above.

An alternative embodiment of the present invention is similar to the preferred embodiment, but provides a bypass electrode arrangement, located along the flight path, but before the detection arrangement, which is arranged to deflect the charged particle beam to continue along the flight path, but to bypass the detection arrangement. Hence, the charged particle beam is able to be accelerated along the flight path for multiple loops, thereby extending the length of the flight path. Then, the bypass electrode arrangement is disabled, causing the charged particle beam to pass through the detectors and be detected.

A modulator may be configured to direct ions into a next stage of analysis, for instance to direct the beam to a different leg of the flight path, or to return the charged particles to an external storage device, or to send the beam to a fragmentation cell.

Restoration of a mass spectrum may be performed using the outputs of all detectors in the mass spectrometer with detector-specific scaling coefficients for corresponding regions of mass spectra. Restoration of the spectrum may additionally have to include deconvolution algorithms, especially in the case that detectors are shared or ions are reflected onto the same path in part of the flight distance.

The first output could be used to physically select intense ion packets (i.e. particular mass peaks) by a modulator, for instance for a MS/MS or MS″ application, in the following way. In a first step, parent particles of certain m/z ratios are selected (for instance, the N most intense peaks from a previous scan, or from a user-defined list, etc.). These m/z ratios are converted into time-of-flight values according to the calibration data for the detector and these values are stored in the memory of a data acquisition system.

The detector then detects a certain set of peaks and the data acquisition system compares the measured times-of-flight with pre-calculated times-of-flight. If the values coincide within certain tolerance, the times-of-flight of these peaks at the modulator are calculated according to the calibration data for the modulator. The times-of-flight for the modulator differ from those for the detector as modulator sits downstream, in a subsequent temporal focus region. Then, trigger signals are sent to the modulator to induce deflection of the previously detected peaks either to a collision cell (if peaks were identified as parent peaks) or to a beam absorber (if they are to be removed). In either case, selected ion packets do not need to pass through or near subsequent detectors.

The invention claimed is:

1. A mass spectrometer comprising:

an electrode arrangement for causing charged particles in a beam to undergo at least three reflections;

a detection arrangement, arranged to detect a first portion of the charged particle beam that has travelled a first path length through the mass spectrometer and that has undergone at least one reflection, and to provide a first output based upon the intensity of the detected first portion of the charged particle beam, the detection arrangement further arranged to detect a second portion of the charged particle beam that has travelled a second path length through the mass spectrometer, the second path length being greater than the first path length, and to provide a second output based upon the detected second portion of the charged particle beam; and a controller, arranged to adjust the parameters of at least one of the charged particle beam and the detection arrangement, based upon the first output of the detection arrangement, so as to adjust the second output of the detection arrangement;

wherein the detection arrangement is arranged to detect the first portion of the charged particle beam at a temporal focusing region; and wherein the electrode arrangement defines a flight path for the charged particle beam and wherein the detection arrangement is located substantially along the last 50% of the flight path.

2. The mass spectrometer of claim 1, wherein the detection arrangement is arranged to detect the second portion of the charged particle beam at a temporal focusing region.

3. The mass spectrometer of claim 1, wherein the detection arrangement is located substantially along the last 10% of the flight path.

4. The mass spectrometer of claim 3, wherein the detection arrangement is located substantially along the last 5% of the flight path.

5. The mass spectrometer of claim 1, wherein the electrode arrangement is arranged to cause the charged particles in the beam to undergo at least 5 reflections.

6. The mass spectrometer of claim 1, wherein the electrode arrangement is arranged to cause the charged particles in the beam to undergo at least 50 reflections.

7. The mass spectrometer of claim 1, wherein the controller is arranged to adjust the second output of the detection arrangement to be within a desired range.

8. The mass spectrometer of claim 7, wherein the controller is arranged to adjust the sensitivity of at least a part of the detection arrangement based upon the first output of the detection arrangement, so as to control the second output of the detection arrangement to be within the desired range.

9. The mass spectrometer of claim 1, wherein the detection arrangement is configured to provide the first output based upon the intensity and time-of-arrival of the detected first portion of the charged particle beam.

10. The mass spectrometer of claim 1, wherein the detection arrangement is configured to provide the second output based upon the time-of-arrival of the detected second portion of the charged particle beam.

11. The mass spectrometer of claim 10, wherein the controller is further arranged to adjust the second output that is based upon the time-of-arrival of the detected second portion of the charged particle beam, on the basis of the first output of the detection arrangement that is based upon the intensity of the detected first portion of the charged particle beam, so as to adjust the second output of the detection arrangement.

12. The mass spectrometer of claim 1, wherein the detection arrangement is configured to provide the second output based upon the intensity of the detected second portion of the charged particle beam.

13. The mass spectrometer of claim 1, the spectrometer further comprising:

a first modulator, located between the location of the detection of the first portion of the charged particle beam and the location of the detection of the second portion of the charged particle beam, and arranged to control the charged particle beam;

wherein the controller is adapted to adjust the modulator based upon the first output of the detection arrangement, so as in turn to regulate the quantity of ions detected as part of the second portion of the charged particle beam, to thereby adjust the second output of the detection arrangement.

14. The mass spectrometer of claim 13, wherein the modulator is located at a temporal focusing region of the mass spectrometer.

15. The mass spectrometer of claim 14, wherein the detection arrangement comprises a second output part, the second output part providing the second output, and wherein the modulator is located at the temporal focusing region immediately upstream from said second output part.

16. The mass spectrometer of claim 13, wherein the controller is further adapted to adjust the modulator to reduce the quantity of ions detected as part of the second portion of the charged particle beam on the basis of the first output of the detection arrangement being greater than a predetermined threshold.

17. The mass spectrometer of claim 1, wherein the detection arrangement comprises a detector located at a temporal focusing region, the detector arranged to detect a first portion of the charged particle beam during a first time period and to provide a first output based upon the detected intensity of the first portion of the charged particle beam, the detector being further arranged to detect a second portion of the charged particle beam at a second time period and to provide a second output based upon the detected second portion of the charged particle beam.

18. The mass spectrometer of claim 1, wherein the detection arrangement comprises:

a first detector arranged to detect a first portion of the charged particle beam and to provide a first output based upon the detected intensity of the first portion of the charged particle beam; and a second detector arranged to detect a second portion of the charged particle beam and to provide a second output based upon the detected second portion of the charged particle beam.

19. The mass spectrometer of claim 18, wherein the first portion of the ion beam is smaller than the second portion of the ion beam.

20. The mass spectrometer of claim 18, wherein the first detector and second detector comprise at least one common amplification stage.

21. The mass spectrometer of claim 1, the detection arrangement further arranged to detect a third portion of, the charged particle beam and to provide a third output based upon the detected third portion of the charged particle beam.

22. The mass spectrometer of claim 21, wherein the controller is further arranged to adjust the parameters of the detection arrangement so as to adjust the third output of the detection arrangement, based upon the second output of the detection arrangement.

23. The mass spectrometer of claim 21, the detection arrangement further comprising:

a first detector arranged to detect a first portion of the charged particle beam and to provide a first output based upon the detected intensity of the first portion of the charged particle beam;

a second detector arranged to detect a second portion of the charged particle beam and to provide a second output based upon the detected second portion of the charged particle beam; and a third detector arranged to detect the third portion of the charged particle beam and to provide a third output based upon the detected third portion of the charged particle beam.

24. The mass spectrometer of claim 23, wherein the controller is further arranged to adjust the parameters of the detection arrangement, so as to adjust the third output of the said third detector, based upon the first output of the said first detector.

25. The mass spectrometer of claim 23, the detection arrangement further comprising:

a second modulator, located between the second detector and the third detector and arranged to control the charged particle beam;

wherein the controller is further adapted to control the second modulator.

* * * * *